US005111608A

United States Patent [19]

Weisheit

[11] Patent Number: 5,111,608

[45] Date of Patent: May 12, 1992

[54] DEFECTIVE BULLET DISLODGER

[76] Inventor: James P. Weisheit, 1330 Leopold St., Jasper, Ind. 47546

[21] Appl. No.: 647,239

[22] Filed: Jan. 29, 1991

[51] Int. Cl.[5] ..... F41D 35/00

[52] U.S. Cl. ..... 42/90; 42/106

[58] Field of Search ..... 42/90, 106, 94

[56] References Cited

U.S. PATENT DOCUMENTS 4,407,083 10/1983 Hasselmann ..... 42/90

4,442,619 4/1984 McCarley ..... 42/106

OTHER PUBLICATIONS

*Shooting Times*, "The Colt Cocker", May 1987, p. 59.

*Primary Examiner*—Michael J. Carone

*Attorney, Agent, or Firm*—Warren D. Flackbert

[57] ABSTRACT

A defective bullet dislodging mechanism employing a framework mounted rotatable shaft serving to move the handle and barrel of a weapon containing the defective bullet with respect to the slide assembly thereof which is maintained at a stationary location, whereupon the bullet is effectively released from a jammed position, falling through an ejection port. The weapon is inverted during the aforesaid dislodging procedure, where contact between a fork clamp at an end of the rotatable shaft and the weapon causes the desired separation and resulting release of the bullet.

6 Claims, 1 Drawing Sheet

DEFECTIVE BULLET DISLODGER

BACKGROUND OF THE INVENTION

As is known, the usage of handguns or semi-automatic pistols is widespread, including law enforcement personnel and individuals. A particular problem oftentimes arises, however, during a reloading operation, i.e. bullet jamming. The latter is typically associated with improper casing size, as by a bulged portion which causes bullet sticking. In other words, the lagging edge or rim of a soft nosed bullet catches on a portion of the feeding ramp, becoming lodged and requiring, sometimes, dangerous procedures for bullet removal.

As a matter of example, the latter may include (1) the hand holding of the pistol and physically forcing the slide back, or (2) forcing the edge of the slide back by pushing action, or (3) urging the pistol against an adjacent object to open the slide for bullet removal.

DESCRIPTION OF THE INVENTION

The invention overcomes the preceding problem by presenting a hand-operated defective bullet dislodger or dislodging apparatus, whereby, upon placement of the pistol and/or handgun at an operational site, the pistol barrel and handle move integrally, while the slide remains in a fixed position. As the barrel and handle continue to move to a final stopped position, an opening or ejection port is revealed through which the now dislodged bullet can freely pass.

The dislodger presented herein is simple in form, easy to use (by rotating or cranking action), is portable, light in weight, and, yet, positively and safely retains the handgun during the defective bullet releasing and/or dislodging procedure.

DESCRIPTION OF THE FIGURES

In any event, a better understanding of the present invention will become more apparent from the following description, taken in conjunction with the accompanying drawing, wherein.

Figure 1:
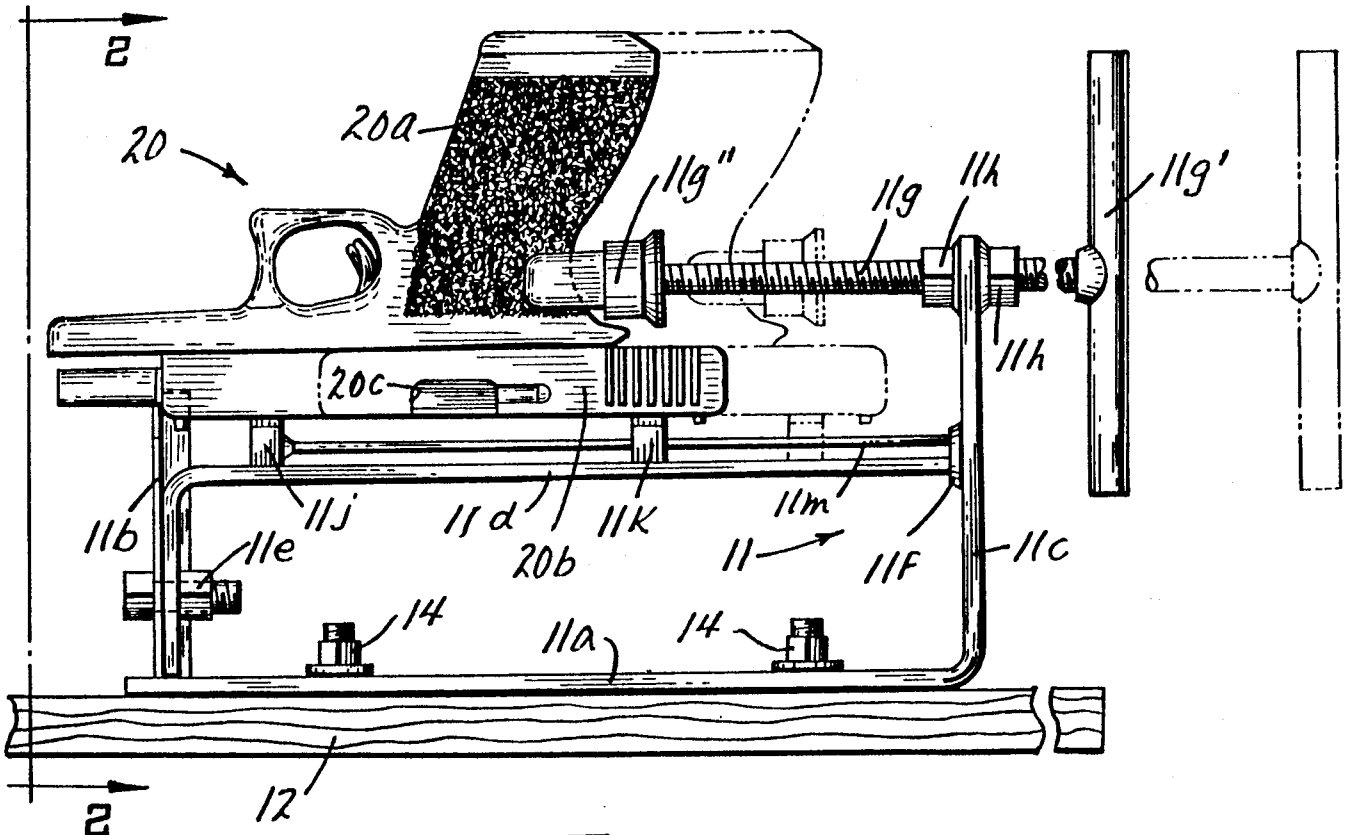
FIG. 1 is a view in side elevation showing a defective bullet dislodger in accordance with the teachings of the present invention, where the illustrated pistol and/or handgun positioned thereon is illustrated by a phantom line initial location and a solid line bullet release location; and, FIG. 2 is a view in end elevation, taken at line 2—2 on FIG. 1 and looking in the direction of the arrows, further detailing the present invention.
Figure 2:
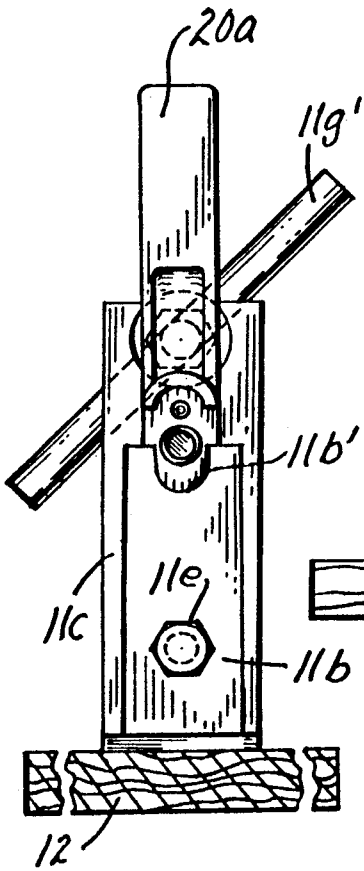

For the purposes of promoting an understanding of the principles of the invention, reference will now be made to the embodiment illustrated in the drawing and specific language will be used to describe the same. It will nevertheless be understood that no limitations of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the figures, the defective bullet dislodger of the invention is defined by a framework 11 including a base 11*a*, an upstanding member 11*b* at one end and another upstanding member 11*c* at an opposite end. Structural re-enforcement is provided by a generally horizontally disposed member 11*d*, typically secured to member 11*b* by a nut-bolt combination 11*e* and to upstanding member 11*c* by welding, at 11*f*.

Upstanding member 11*c* extends above reinforcing member 11*d* and, as well, the upper end of upstanding member 11*b*, where the height of such is typically controlled by the type of handgun and/or pistol involved.

Upstanding member 11*c* further includes an opening (not shown) adapted to receive an elongated threaded member 11*g*, where nuts 11*h*, on opposite sides of upstanding member 11*c*, provide threads cooperative with the threads of elongated member 11*g*. The latter further includes a crank or handle 11*g*', as a straight metal bar, secured to one end, and a universally mounted positioning or fork clamp 11*g*" at an opposite end.

The fork clamp 11*g*" includes a concave shaped leading portion adapted to partially encircle and/or receive a portion of the weapon under service. The assembly is completed by a fixed support bar 11*j* secured to the upper surface of the reinforcing member 11*d* and another support bar 11*k* slidable along a rod 11*m*. Support bars 11*j* and 11*k* serve positioning purposes, i.e., and particularly, are adaptable to weapon configuration.

As also apparent in FIG. 1, base 11*a* of the framework 11 may be secured to a table or like surface 12, bolts 14 typically serving fastening purposes.

A handgun or semi-automatic automatic pistol 20 (after removal of the magazine), inverted so that handle 20*a* thereof faces upwardly, is placed on the mechanism so that slide assembly 20*b* thereof rests within a cut-out portion 11*b*' at the top of upstanding member 11*b*, and the remainder of the weapon rests on support members 11*j* and 11*k*, ultimately abutting, at the front end, with the inside surface of the upstanding member 11*b* (see the solid line representation in FIG. 1).

The fork clamp 11*g*" is moved into engagement with the pistol 20, i.e. partially surrounding a portion of the handle 20*a* thereof, where rotation of crank 11*g*' serves to positively move the handle 20*a*, and the barrel, from the phantom line position of FIG. 1.

In use, and as the clamp 11*g*" moves from right to left in FIG. 1, due to rotation of crank 11*g*', the slide assembly 20*b* of pistol 20 remains at a fixed position, while, as stated, the handle 20*a* (and barrel) integrally move to the solid line position (to the left) in such figure.

As such time, a slide lock (not shown) is manually engaged, and while still holding such, and with reversal of cranking direction, the slide assembly 20*b* is in a locked position, whereupon the bullet is removed through ejection port 20*c*, and the pistol is clear for use.

As evident, therefore, the dislodging of a jammed bullet, a prime concern, is readily accomplished without the danger of personal harm to the user. In other words, the weapon is always at a controlled location and the bullet is incapable of being fired, but, instead, simply passes, as by gravity, from the weapon.

The dislodger described above is susceptible to various changes within the spirit of the invention, including, by way of example, in proportioning; the manner of achieving movement of the fork clamp; the precise shape of the fork clamp; and, the like. Thus, the preceding should be considered illustrative and not as limiting the scope of the following claims.

I claim:

1. In combination with a handgun, a mechanism serving to dislodge a bullet jammed within said handgun, the latter including a barrel, a handle and a slide assembly, comprising a framework, said handgun mounted in an inverted position on said framework, and clamp means disposed at one end of a rotatable shaft mounted on said framework engaging and moving said handle and said barrel of said handgun with respect to said slide assembly which remains at a stationary location, where said movement of said handle and said barrel reveals an ejection port in said slide assembly through which said bullet, now dislodged, passes.

2. The combination of claim 1 where said clamp means partially encircles said handle of said handgun.

3. The mechanism of claim 1 where the rotatable shaft includes a handle on a second end which controls the selective movement of said rotatable shaft.

4. The combination of claim 1 where said framework includes a generally horizontal reinforcing member carrying supports for said handgun at said inverted position.

5. The combination of claim 1 where said framework includes an upstanding member against which said slide assembly bears upon movement of said handle and said barrel.

6. The combination of claim 1 where said handle and said barrel move simultaneously.

* * * * *